US010527243B2

(12) United States Patent
Ganz et al.

(10) Patent No.: US 10,527,243 B2
(45) Date of Patent: Jan. 7, 2020

(54) CANDLE WITH SIMULATED FLAME

(71) Applicant: GANZ, Woodbridge (CA)

(72) Inventors: Jessie Ganz, Woodbridge (CA); Colleen Booth, Cypress, TX (US); Annette Hansen, Woodbridge (CA); Donald J. Firca, Jr., Akron, OH (US)

(73) Assignee: GANZ (CA)

( * ) Notice: Subject to any disclaimer, the term of this patent is extended or adjusted under 35 U.S.C. 154(b) by 0 days.

(21) Appl. No.: 16/466,701

(22) PCT Filed: Dec. 11, 2017

(86) PCT No.: PCT/IB2017/001641
§ 371 (c)(1),
(2) Date: Jun. 5, 2019

(87) PCT Pub. No.: WO2018/104788
PCT Pub. Date: Jun. 14, 2018

(65) Prior Publication Data

US 2019/0338906 A1 Nov. 7, 2019

Related U.S. Application Data

(60) Provisional application No. 62/432,249, filed on Dec. 9, 2016.

(51) Int. Cl.
*F21S 10/04* (2006.01)
*F21S 9/02* (2006.01)
(Continued)

(52) U.S. Cl.
CPC ..... *F21S 10/046* (2013.01); *F21S 6/001* (2013.01); *F21S 9/02* (2013.01); *F21Y 2115/10* (2016.08)

(58) Field of Classification Search
CPC ..... F21S 10/04; F21S 10/046; F21S 6/001; Y10S 362/81
See application file for complete search history.

(56) References Cited

U.S. PATENT DOCUMENTS 9,335,014 B2 5/2016 Patton et al.
9,366,402 B2 6/2016 Li
(Continued)

FOREIGN PATENT DOCUMENTS

CN 203273669 U 11/2013
WO 2015109115 A1 7/2015

OTHER PUBLICATIONS

Patent Cooperation Treaty (PCT) International Search Report and Written Opinion issued in PCT International Application PCT/IB2017/001641, having an International Filing Date of Dec. 11, 2017 dated Apr. 17, 2018 (8 pgs).

*Primary Examiner* — Andrew J Coughlin

(57) ABSTRACT

Provided is a candle with a simulated flame. A housing is formed from wax and defines an interior space. A ceiling of the housing includes a depression with a perimeter wall formed from the wax that extends downward, into the depression to a depression floor. A flame member is pivotally supported above the depression floor, and includes a flame region having a shape resembling a flame silhouette that and a lower region that is suspended from the base. A flame support is provided to the depression floor that pivotally supports the base of the flame member externally of the interior space and the housing. A light is provided and, when operated, emits light onto the flame region while a driver generates an electromagnetic field that interacts with the lower region within the interior space to cause pivotal movement of the flame member on the flame support.

19 Claims, 4 Drawing Sheets

(51) Int. Cl.
*F21S 6/00* (2006.01)
*F21Y 115/10* (2016.01)

(56) References Cited

U.S. PATENT DOCUMENTS

| | | | | |
|---|---|---|---|---|
| 9,371,973 | B2 | 6/2016 | Li | |
| 9,447,938 | B2 | 9/2016 | Li | |
| 9,512,971 | B2 | 12/2016 | Li | |
| 9,523,471 | B2 | 12/2016 | Li | |
| 9,541,247 | B2 | 1/2017 | Patton | |
| 9,585,980 | B1 * | 3/2017 | Li | F21S 6/001 |
| 9,591,729 | B2 | 3/2017 | Patton | |
| 9,657,910 | B2 | 5/2017 | Patton | |
| 2006/0034100 | A1 * | 2/2006 | Schnuckle | B44C 5/06 362/161 |
| 2012/0134157 | A1 | 5/2012 | Li | |
| 2014/0104812 | A1 * | 4/2014 | Patton | F21S 10/046 362/96 |
| 2016/0040843 | A1 | 2/2016 | Patton et al. | |
| 2016/0146413 | A1 | 5/2016 | Wu | |
| 2016/0298816 | A1 | 10/2016 | Fang | |
| 2017/0067608 | A1 * | 3/2017 | Patton | F21S 10/046 |
| 2017/0167677 | A1 * | 6/2017 | Patton | F21S 6/001 |

* cited by examiner

CANDLE WITH SIMULATED FLAME

CROSS-REFERENCE TO RELATED APPLICATIONS

This disclosure is a 371 of international PCT Application PCT/IB2017/001641 Ser. No. filed Dec. 11, 2017, title "CANDLE WITH SIMULATED FLAME," inventors Jessie GANZ, Colleen BOOTH, Annette HANSEN, and Donald J. FIRCA, JR., which claims benefit of U.S. Provisional Application 62/432,249 Ser. No., filed Dec. 9, 2016 title "CANDLE WITH SIMULATED FLAME,"inventors Jessie GANZ, Colleen BOOTH, Annette HANSEN, and Donald J. FIRCA, JR. , and assigned to the present assignee, which is incorporated herein in its entirety by reference.

BACKGROUND OF THE INVENTION

1. Field of the Invention

This application relates generally to an apparatus for simulating a candle and, more specifically, to a candle with a pivotally-mounted flame member that is illuminated to simulate a flame.

2. Description of Related Art

Conventional candles include a wick embedded in a solid wax body. The exposed end of the wick is lit, and allowed to burn down as the surrounding wax is melted. Although the soft glow of flickering light provided by candles establishes a relaxing atmosphere, they constitute a fire hazard that makes them unsuitable for use in apartment buildings, office buildings, commercial displays and other settings.

More recently, simulated candles have been developed to provide a similar ambiance to that created by conventional candles without the use of fire. Such candles include a housing in which a flame member, light and other components are installed. The flame member mounted within a known housing extends through a hole at the top of the housing, above which the flame member is visible. Installing these internal components inside of an interior space defined by the housing, however, makes the assembly process complex and labor intensive, and subject to quality-control issues.

BRIEF SUMMARY OF THE INVENTION

Accordingly, there is a need in the art for a candle with a simulated flame offering simplified assembly with repeatable results.

According to one aspect, the subject application involves a candle with a simulated flame. Such a candle includes a housing formed from a wax that is substantially cylindrical in shape and defines an interior space. The housing includes a vertically-oriented side wall extending circumferentially about the interior space, and a horizontally-oriented ceiling that is integrally formed from the wax together with the side wall as a monolithic structure. The ceiling includes a depression with a perimeter wall formed from the wax that extends downward, into the depression from the ceiling to a depression floor. A flame member is pivotally supported on the depression floor, and includes a base, a flame region having a shape resembling a flame silhouette that extends upward from the base, and a lower region that is suspended from the base and supports a swing component formed from a magnetic or ferromagnetic material. A flame support is provided to the depression floor that pivotally supports the base of the flame member externally of the interior space and the housing. A light is provided and, when operated, emits light onto the flame region. A driver generates an electromagnetic field that interacts with the swing component within the interior space to cause pivotal movement of the flame member on the flame support.

According to another aspect, the subject application involves a candle with a simulated flame. The candle includes a housing that defines an interior space, and a flame member with a base, a flame region having a shape resembling a flame silhouette that extends upward from the base, and a lower region that is suspended from the base and supports a swing component formed from a magnetic or ferromagnetic material. A flame support pivotally supports the base of the flame member externally of the interior space and the housing. A control assembly is at least partially disposed within the interior space defined by the housing. The control assembly includes a driver with a coil electrically connected to a switching circuit for generating an electromagnetic field that interacts with the swing component within the interior space to cause pivotal movement of the flame member. A light post extends upward from the control assembly in the interior space, and a light is supported adjacent to a distal end of the light post within the interior space to emit light onto the upper region of the flame member through an aperture formed in the housing.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF SEVERAL VIEWS OF THE DRAWING

The invention may take physical form in certain parts and arrangement of parts, embodiments of which will be described in detail in this specification and illustrated in the accompanying drawings which form a part hereof and wherein.

DETAILED DESCRIPTION OF THE INVENTION

Figure 1:
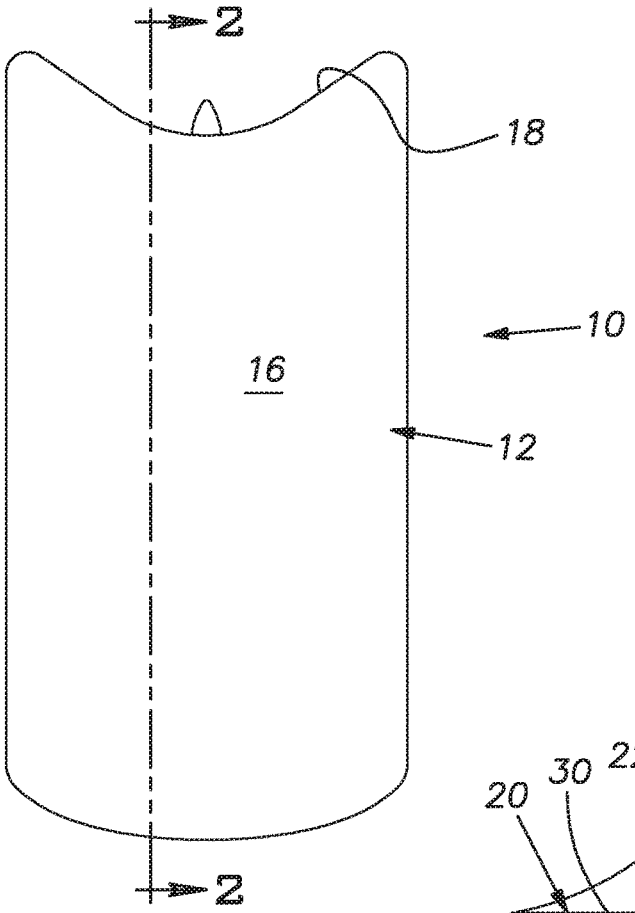
FIG. 1 is a side view of a candle including a simulated flame in accordance with an embodiment of the present technology.

Certain terminology is used herein for convenience only and is not to be taken as a limitation on the present invention. Relative language used herein is best understood with reference to the drawings, in which like numerals are used to identify like or similar items. Further, in the drawings, certain features may be shown in somewhat schematic form.

It is also to be noted that the phrase "at least one of", if used herein, followed by a plurality of members herein means one of the members, or a combination of more than one of the members. For example, the phrase "at least one of a first widget and a second widget" means in the present application: the first widget, the second widget, or the first widget and the second widget. Likewise, "at least one of a first widget, a second widget and a third widget" means in the present application: the first widget, the second widget, the third widget, the first widget and the second widget, the first widget and the third widget, the second widget and the third widget, or the first widget and the second widget and the third widget.

Figure 2:
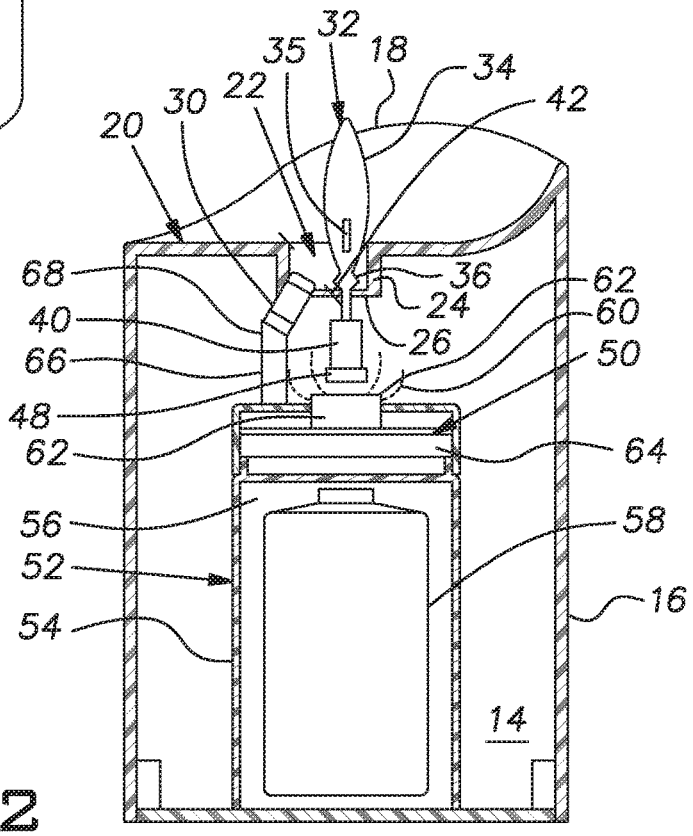
FIG. 2 is a partially-cutaway view of the candle taken along line 2-2 in FIG. 1, showing an illustrative embodiment of a pivotal mounting of a flame member outside of an interior space defined by a housing, and a control assembly disposed at least partially within the interior space supporting a post with a light arranged at a distal end thereof.
Figure 3:
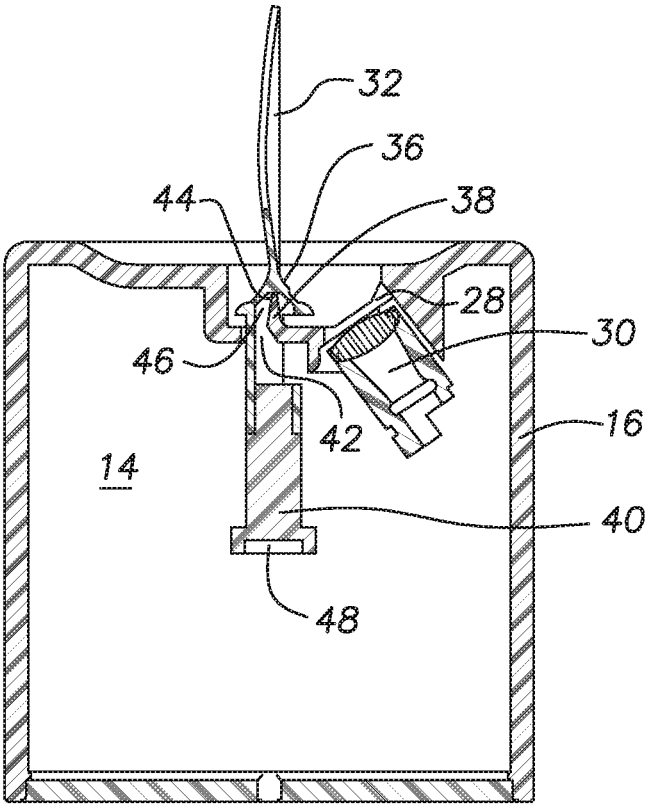
FIG. 3 is a partially-cutaway view of the candle taken along line 2-2 in FIG. 1, showing another illustrative embodiment of a pivotal mounting of a flame member outside of an interior space defined by a housing, with a control assembly omitted from the interior space for illustration purposes.

FIG. 1 shows a side view of an illustrative embodiment of a candle 10 including a simulated flame in accordance with an embodiment of the present disclosure. As shown, the candle 10 includes a housing 12 that is substantially cylindrical in shape, and defines an interior space 14 (FIGS. 2 and 3). The housing 12 includes an arcuate, vertically-oriented side wall 16 that extends circumferentially about a longitudinal axis to enclose the interior space 14. The upper region of the candle 10 can optionally include an undulating rim 18 to create an appearance resembling melted wax surrounding a wick of a conventional candle that has been burned, or a substantially planar surface to create the appearance of a flat-top candle.

FIG. 2 shows a partially-cutaway view of the candle 10 taken along line 2-2 in FIG. 1. The housing 12 includes a horizontally-oriented ceiling 20 that is integrally formed together with the side wall 16 as a single, monolithic structure. A depression 22 is formed as part of the ceiling 20, and includes a perimeter wall 24 that is also formed as part of the same monolithic structure forming the ceiling 20 and the side wall 16, and extends downward from the ceiling 20 to a depression floor 26 defining a bottom of the depression 22. The perimeter wall 24, similar to the side wall 16, can be substantially vertical, forming a cylindrical shape, extending in an arcuate manner about the entire circumference of the depression floor 26. According to alternate embodiments, the perimeter wall 24 can optionally taper downward, meaning a distance between opposite surfaces of the perimeter wall 24 through a central region of the depression floor 26 is less near the depression floor 26 than it is near the top of the perimeter wall 24. Collectively, the ceiling 20, the perimeter wall 24 and the depression floor 26 enclose the top of the interior space 14, which is bound about its lateral periphery by the side wall 16.

The embodiment of the candle 10 shown in FIG. 2 includes a housing 12 molded as a monolithic structure from a polymeric material, plastic resin, other rigid material, or any combination thereof. The depression floor 26 is molded or otherwise formed in such a way to define a light aperture 28 therein as shown in FIG. 5. Light emitted by a light emitting diode ("LED") or other suitable type of light 30 (FIGS. 2-4) supported adjacent to the light aperture 28 passes through the light aperture 28 to at least partially illuminate a flame region 34 of a flame member 32 as described below. Although the light aperture 28 is defined entirely by the depression floor 26 in FIG. 5, alternate embodiments of the light aperture 28 can optionally be defined collectively by the depression floor 26 and the perimeter wall 24 of the depression 22 as shown in FIG. 3, for example, without departing from the scope of the present disclosure.

A flame support 38 is provided to the depression floor 26 to pivotally support the flame member 32 externally of the housing 12. For the embodiment shown in FIG. 2, the flame support 38 includes a flat region, a pyramidal region, or a frusto-conical region extending upward from the depression floor 26 surrounding another aperture 42 in the depression floor 26. According to an alternate embodiment, the flame support 38 includes a conical structure that extends upwardly from the depression floor 26 as shown in FIG. 3. A peak 44 of the flame support 38 forms a fulcrum received in the apex region of a pyramidal recess 46 defined by the underside of the base 36 of the present embodiment. However, any suitable structure that supports the base 36 of the flame region 34 at an elevation vertically above the depression floor 26 can be used.

The embodiment of the housing 12 discussed above is formed from the plastic or polymeric resin material. According to an alternate embodiment, the housing 12 can include a wax shell 12B (FIG. 5) forming the outer, exposed surface of the housing 12 to provide the candle 10 with the look and feel of a candle with a wick that is burned. For example, as shown in FIG. 5, an embodiment of the housing 12 includes a polymeric or plastic resin housing 12A, as an inner housing, over which a wax shell 12B is formed to be concentrically aligned with the polymeric or plastic resin housing 12A. The wax shell 12B can optionally be formed as a wax coating cast, molded or otherwise applied to the exterior surfaces of the polymeric or plastic resin housing 12A.

Any suitable candle wax can be used to form the wax shell 12B. Wax is an organic compound constructed of long alkyl chains derived from naturally-occurring from animals or plants (e.g., beeswax, or synthetic (e.g., petroleum based) sources. Wax is a hydrophobic, malleable solid at room temperature, melting at temperatures typically above about 104° F. to produce low-viscosity liquids. As a result of their typical non-polar structures, waxes are insoluble in water but soluble in organic, non-polar solvents. Examples of suitable synthetic waxes include, but are not limited to long-chain hydrocarbons (alkanes or paraffins) that lack substituted functional groups, natural waxes derived from plant and/or animal sources with unsubstituted hydrocarbons, such as higher alkanes, and substituted long chain compounds, such as fatty acids, primary and secondary long chain alcohols, ketones and aldehydes.

Regardless of how the wax shell 12B is formed or the specific wax material utilized, the wax shell 12B can form a monolithic structure that extends continuously over the side wall 16 and the ceiling 20 of the polymeric or plastic resin housing 12A. As shown in FIG. 5, the wax shell 12B can include a upright portion 27 extending into the depression 22, along the entire height of the perimeter wall 24 defining the lateral periphery of the depression 22, terminating at the depression floor 26. According to alternate embodiments, instead of terminating at the depression floor 26, the wax forming the portion of the wax shell 12B along the ceiling 20 can optionally include a bottom, protruding region 29 that protrudes from the upright portion 27 laterally inward into the depression 22, over the depression floor 26 toward the flame support 38. For any of these embodiments, the flame support 38 is configured such that the peak 44 shown in the embodiment of FIG. 5 or other structure that contacts the base 36 to pivotally support the flame member 32 is disposed at an elevation vertically above the elevation at which the lowermost portion of the wax shell 12B extends into the depression 22. In other words, if the wax layer 12 includes only the upright portion 27 that terminates at the depression floor 26, but does not include the bottom region 29 extending radially inward toward the flame support 38, then the peak 44 or other supporting structure extends upward, vertically above the elevation at which the upright portion 27 of the wax terminates. Similarly, for embodiments that include the bottom region 29, the peak 44 or other supporting structure extends vertically above the elevation of that bottom region 29 as shown in FIG. 5. Accordingly, the peak 44 or other supporting structure is located externally of the housing 12, including the wax shell 12B, separated from the interior space 14 by the housing 12.

Figure 5:
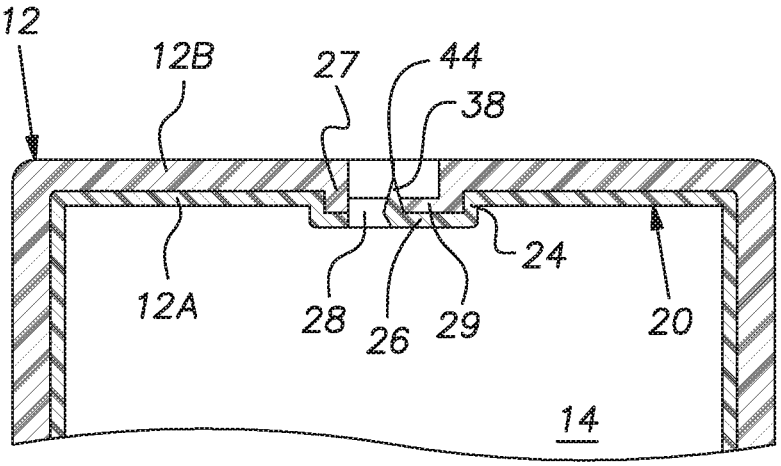
FIG. 5 is a schematic view of an embodiment of a flame support provided to a candle housing having an exterior surface formed from wax.
Figure 6:
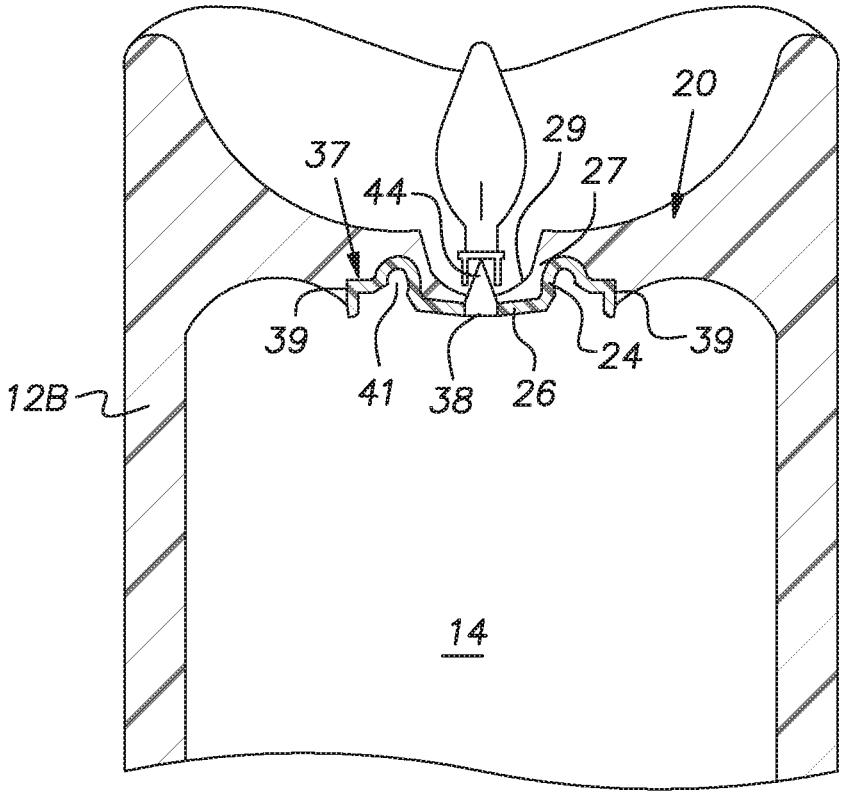
FIG. 6 is a partially-cutaway view of the candle taken along line 2-2 in FIG. 1, showing a plastic member embedded in wax forming a portion of the ceiling of the housing, the plastic member supporting an upwardly-extending pivot pin as a support member that pivotally supports a flame member externally of the housing.

FIG. 6 shows another illustrative embodiment of the housing 12 of the candle, in a sectional view taken along line 2-2 of FIG. 1. For the present embodiment, the housing 12 can be formed to include only the wax shell 12B as a stand-alone structure, lacking a liner or inner housing such as the polymeric or plastic resin housing 12A shown in FIG. 5. In the absence of the polymeric or plastic resin housing 12A, a plastic member 37 can be embedded in the liquid wax during the formation of the housing 12 to form a portion of the ceiling 20 that defines the depression floor 26 and supports the flame member 32. Although referred to as a "plastic" member 37, it is to be understood that other suitably-rigid materials that can withstand the temperatures of the melted wax and remain solid can also be used to form the "plastic" member 37. As shown in FIG. 6, the plastic member 37 has terminal, lateral ends 39 recessed radially inward from the side wall 16. Thus, the plastic member 37 extends across a portion, but less than the entire ceiling 20, and is held in place by the wax that has cooled to solidify around portions of the plastic member 37. The plastic member 37 is also shaped to define the perimeter wall 24 and the depression floor 26 of the depression 22, and an arcuate channel 41 or channel of another suitable shape that extends at least partially, and optionally entirely around the perimeter wall 24. The arcuate channel 41 can be used to align the position of the light 30 supported by a control assembly 52 as described in detail below. An upwardly-extending flame support 38 shown in FIG. 6 as the conical pivot pin that pivotally supports the flame member 32 is provided to the plastic member 37.

The plastic member 37 shown in FIG. 6 is provided, on its outermost surface, with a wax shell 12B that conceals most of the plastic member 37 from view when the candle 10 is observed during operation. To minimize the visibility of the plastic member 37, the plastic member 37 can be formed from a material having a color that resembles the color of the wax forming the wax shell 12B. Similar to the preceding embodiments, the wax shell 12B can include the upright portion 27 extending into the depression 22 from above, along the entire height of the perimeter wall 24 defining the lateral periphery of the depression 22, terminating at the depression floor 26. The upright portion does not necessarily have to be vertical, but can be inclined to taper into the depression 22. According to alternate embodiments, instead of terminating at the depression floor 26, the wax forming the portion of the wax shell 12B along the ceiling 20 can optionally include a bottom, protruding region 29 that extends from the upright portion 27 laterally inward into the depression 22, over the depression floor 26 toward the flame support 38. Again, for any of these embodiments, the flame support 38 is configured such that the peak 44 shown in the embodiment of FIG. 6 or other structure that contacts the base 36 to pivotally support the flame member 32 is disposed at an elevation vertically above the elevation at which the lowermost portion of the wax shell 12B extends into the depression 22. In other words, if the wax shell 12B includes only the upright portion 27 that terminates at the depression floor 26, but does not include the bottom protruding region 29 extending radially inward toward the flame support 38, then the peak 44 or other supporting structure extends upward, vertically above the elevation at which the upright portion 27 of the wax terminates. Similarly, for embodiments that include the bottom protruding region 29, the peak 44 or other supporting structure extends vertically above the elevation of that bottom region 29 as shown in FIG. 6. Accordingly, the peak 44 or other supporting structure is located externally of the housing 12, including the wax shell 12B, separated from the interior space 14 by the housing 12.

Referring once again to FIG. 2, the flame member 32 includes a base 36 in the form of a bulbous region that rests on the flame support 38 region of the depression floor 26 to pivotally support the flame member 32 externally of the housing 12. In other words, the bulbous region of the base 36 has a diameter or other dimension that is greater than a corresponding dimension of the aperture 42 formed in the depression floor 26, to allow the base 36 to rest on the flame support 38, which is outside of the interior space 14 defined by the housing 12. The portion of the base 36 that interacts with the flame support 38 is separated from the interior space 14 by the depression floor 26 or other portion of the ceiling 20.

The flame member 32 also includes a flame region 34 having a shape resembling a flame silhouette that extends upward from the base 36. The flame region 34 can optionally include an elongated aperture 35 formed therein that is dark, resembling the appearance of a wick visible through an actual flame when the flame region 34 is illuminated by the light 30. A lower region 40 is suspended from the base 36 to extend through the aperture 42 formed in the depression floor 26 and into the interior space 14. The lower region 40 can optionally be separable from the base 36, allowing the lower region 40 to be repeatedly removed and reassembled on the base 36 without damaging the structure to an extent that would result in the lower region 40 falling from the base 36 under the force of gravity. Thus, the lower region 40 of the flame member 32 can be extended through the aperture 42 in the depression floor 26 and connected to the base 36 during assembly.

A swing component 48 is coupled to the lower region 40 of the flame member 32. The swing component 48 can be a disc or structure of another shape formed from a magnetic and/or a ferromagnetic material on which a force is exerted by the electromagnetic field generated by a driver 50 supported by a control assembly 52 within the interior space 14. The control assembly 52 includes a control housing 54 defining a battery compartment 56 in which a battery 58 supplying the electric energy for generating the electromagnetic field 60 is to be stored. The driver 50 includes a coil 62 wound about a spool electrically connected to a switching circuit 64. Electric energy supplied by the battery 58 is delivered to the switching circuit 64, which is configured to turn the direct current from the battery on and off to supply an alternating current to the coil 62. The switching circuit 64 can switch the electric energy from the battery 58 on and off to establish any desired waveform, such as square-wave pulses having variable widths (e.g., on-time durations), but separated from each other by uniform delays (e.g., off times). Conduction of the alternating waveform voltage by the coil 62 emits the electromagnetic field 60 in the interior space 14 that attracts and/or repels the swing component 48 provided to the lower region 40 of the flame member 32, causing the flame member 32 to pivot. The varying widths of the pulses continuously generates a variable electromagnetic field 60 that helps promote a chaotic movement of the flame member 32, thereby enhancing the flickering appearance of the simulated flame.

Figure 7:
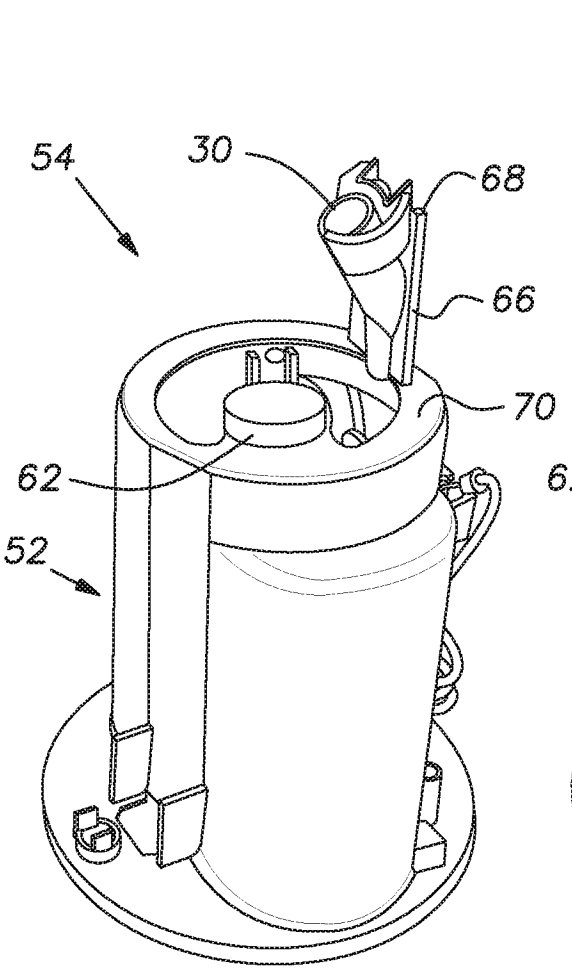
FIG. 7 shows an illustrative embodiment of a control assembly for generating an alternating electromagnetic field that interacts with a magnetic or ferromagnetic material provided to a lower region of a flame member, the control assembly supporting an upward-extending post including a light at a distal end to emit light through an aperture in a ceiling of the housing to illuminate a flame region of the flame member.

In addition to supporting the driver 50, the control assembly 52 can also optionally support a light post 66. As shown in FIGS. 2 and 7, the light post 66 can extend upward from a portion of the housing 54, a printed circuit board on which the switching circuit 64 is formed, or any other portion of the control assembly 52. A distal end 68 of the light post 66 supports the light 30 adjacent to, and optionally extending into the light aperture 28 that is at least partially defined by the depression floor 26. So positioned, the light 30 emits light onto the upper, flame region 34 of the flame member 32 visible above the depression floor 26.

For the embodiment shown in FIG. 7, the light post 66 is integrally formed with, or coupled to a rim 70 of the housing 54 that extends circumferentially around a region where the coil 62 is supported by the control assembly 52. The rim 70 can be spaced a radial distance outside of the perimeter of the coil 62 and a region defined by the rim 70 left open, and unobstructed to expose the coil 62 to the interior space 14 where the lower region 40 of the flame member 32 is supported. Exposing the coil 62 to the lower region 40 of the flame member 32 in this manner is believed to minimize attenuation of the electromagnetic field 60 that could otherwise occur if a dielectric barrier was arranged between the lower region 40 and the coil 62. Thus, the coil 62 may be recessed within the housing 54 at a vertical elevation lower than the rim 70 to be considered located inside of the housing 54, the region vertically above the coil 62 can optionally be unobstructed, directly exposing the lower region 40 and accordingly the swing component 48 to the coil 62.

Figure 8:
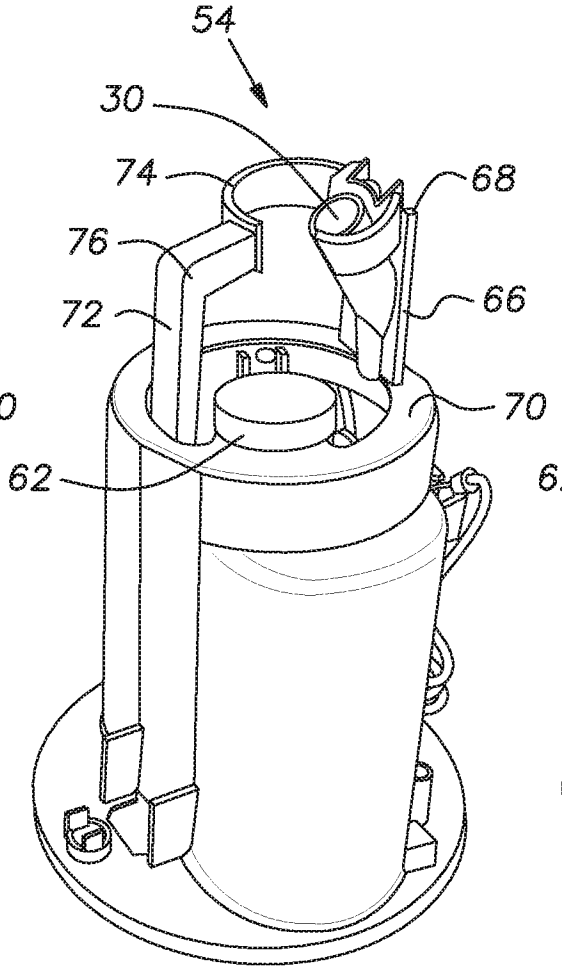
FIG. 8 shows another illustrative embodiment of a control assembly for generating an alternating electromagnetic field that interacts with a magnetic or ferromagnetic material provided to a lower region of a flame member, the control assembly supporting an upward-extending post including a light at a distal end to emit light through an aperture in a ceiling of the housing to illuminate a flame region of the flame member.

To help stabilize and properly position the light 30 supported by the light post 66 on the control assembly 52 adjacent to and/or in the light aperture 28, a brace 72 can optionally also be positioned to extend upward from the rim 70 of the housing 54 as shown in FIG. 8. Similar to the light post 66, the brace 72 can be an elongate member integrally formed with, or coupled to a different portion of the rim 70 than the light post 66. A linkage 74 extends between a distal end 76 of the brace 72 and the distal end 68 of the light post 66. For the embodiment shown in FIG. 8, the brace 72 is positioned on an opposite side of the coil 62 as the light post 66, approximately 180° about the rim 70 from the light post 66. To allow the lower region 40 of the flame member 32 to be suspended above the coil 62 without interference from the linkage 74, the linkage 74 can be provided with a semi-circular arcuate shape that extends partially, but not entirely around the perimeter of the region vertically above the coil 62. Thus, the light post 66, the brace 72 and the linkage 74 do not collectively or individually form an enclosure enclosing the coil 62 and/or the region vertically above the coil 62 wherein the light 30 is supported.

Although described herein as being arcuate to extend about the region vertically above the coil 62, it is to be understood that the shape of the linkage 74 is not necessarily limited to a continuously-curved surface. For example, the linkage 74 can be formed from a plurality of linear segments that intersect each other to form a somewhat "V" shaped structure between the brace 72 and the light post 66.

Figure 9:
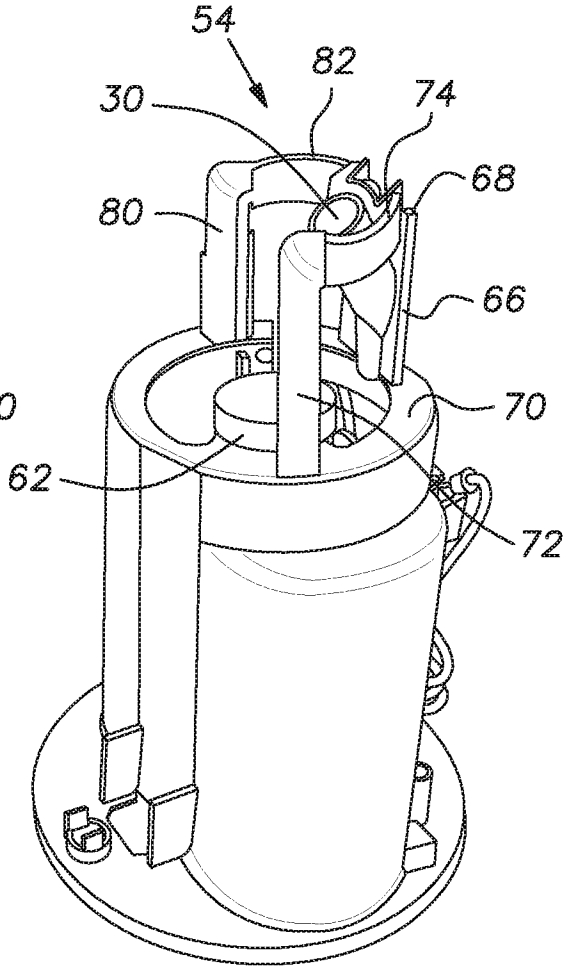
FIG. 9 shows another illustrative embodiment of a control assembly for generating an alternating electromagnetic field that interacts with a magnetic or ferromagnetic material provided to a lower region of a flame member, the control assembly supporting an upward-extending post including a light at a distal end to emit light through an aperture in a ceiling of the housing to illuminate a flame region of the flame member.

An alternate embodiment of the structure for stabilizing and aligning the light 30 is shown in FIG. 9. According to this alternate embodiment, the brace 72 is arranged approximately 90° about the rim 70 from the light post 66, instead of arranged on the opposite side of the coil 62 as shown in FIG. 8. Similar to the preceding embodiment, the linkage 74 is again formed as an arcuate member, and extends between the brace 72 and the light post 66 outside of the region vertically above the coil 62 to avoid interfering with movement of the lower region 40 of the flame member extending into the interior space 14. In the present embodiment, however, a second brace 80 is arranged approximately 90° about the rim 70 from the light post 66 in the opposite direction relative to the brace 72. A second linkage 82 extends between the second brace 80 and the light post 66. According to such an embodiment, the linkages 74, 82 approach the light post 66 from opposite, or at least different directions to stabilize the light 30, without collectively or individually forming an enclosure fully or completely enclosing the coil 62 and/or the region vertically above the coil 62 wherein the light 30 is supported.

For purposes of properly positioning the light 30 supported on the light post 66 relative to the light aperture 28, at least a portion of the linkage 74 shown in FIG. 8, and at least a portion of the linkages 74, 82 shown in FIG. 9, can optionally be received within the channel 41 described above with reference to FIG. 6. This channel 41 extends about at least a portion of the perimeter wall 24 defining the depression 22, thus aligning the linkage 74, and accordingly the distal end 68 of the light post 66 and light 30, at a predetermined location relative to the depression 22. So aligned, the light 30 is properly positioned to emit light through the light aperture 28 (FIGS. 3 and 5) and onto the flame region 34 of a flame member 32 without being obstructed.

Figure 4:
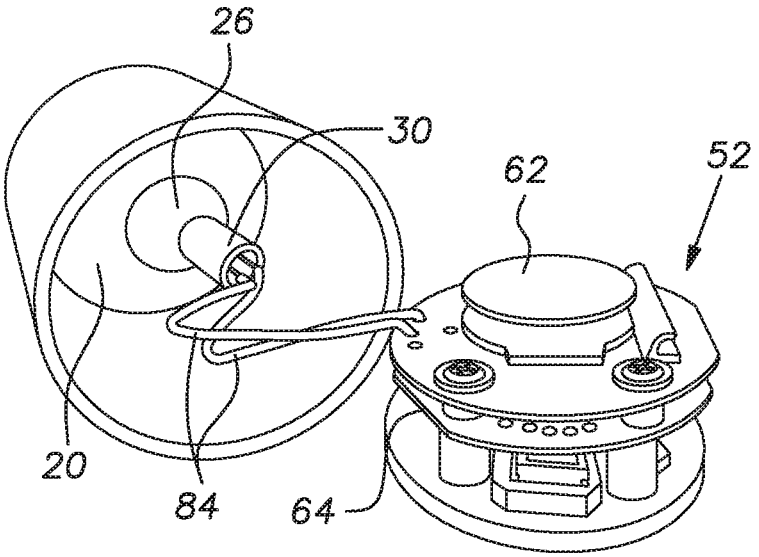
FIG. 4 is a disassembled view of a votive candle with a housing separated from a control assembly, and a light suspended from a ceiling of the housing.

Instead of supporting the light 30 on a light post 66, an alternate embodiment of the candle 10, configured to resemble a votive candle (e.g., the diameter of the housing is approximately equal to, or at least within an inch of the height of the housing 12), is shown in FIG. 4. The present embodiment includes a light 30 suspended from the depression floor 26 of the ceiling 20. Wires 84 establish an electrical connection between the control assembly 52 and the light 30 to allow for selective operation of the light 30 during operation of the candle 10. According to such an embodiment, the light post 66 and any braces 74, 82 discussed above can be eliminated.

Illustrative embodiments have been described, hereinabove. It will be apparent to those skilled in the art that the above devices and methods may incorporate changes and modifications without departing from the general scope of this invention. It is intended to include all such modifications and alterations within the scope of the present invention. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A candle with a simulated flame, the candle comprising:

a housing formed from a wax that is substantially cylindrical in shape and defines an interior space, the housing comprising:

a vertically-oriented side wall, and a horizontally-oriented ceiling that is integrally formed from the wax together with the side wall as a monolithic structure, and comprises a depression with a perimeter wall formed from the wax that extends downward from the ceiling to a depression floor;

a flame member comprising a base, a flame region having a shape resembling a flame silhouette that extends upward from the base, and a lower region that is suspended from the base and supports a swing component formed from a magnetic or ferromagnetic material;

a flame support provided to the depression floor that pivotally supports the base of the flame member externally of the interior space;

a light that is operable to emit light onto the flame region; and a driver for generating an electromagnetic field that interacts with the swing component within the interior space to cause pivotal movement of the flame member on the flame support.

2. The candle of claim 1, wherein the flame support extends upwardly from the depression floor to an elevation vertically above a bottom of the wax forming the perimeter wall of the depression.

3. The candle of claim 1, wherein the perimeter wall of the depression comprises a protruding portion that extends transversely from the perimeter wall onto the depression floor in a horizontally-inward direction, toward a central region of the depression floor.

4. The candle of claim 1, wherein the housing formed from the wax is concentrically aligned over an inner housing formed as a molded polymeric structure, the inner housing comprising a perimeter side wall and a ceiling formed together as a monolithic structure.

5. The candle of claim 1, wherein the housing formed from the wax is a standalone structure, that lacks a liner formed from a polymeric material that is concentrically aligned with the housing.

6. The candle of claim 1, wherein the lower region of the flame member extends through an aperture formed in the depression floor, and the swing component is supported within the interior space defined by the housing.

7. The candle of claim 1, wherein the lower region of the flame member is separable from the base, and is configured to be connected to the base through the depression floor.

8. The candle of claim 1, wherein the driver comprises a coil electrically connected to a switching circuit that is operable to deliver an alternating square wave signal to the coil, the coil and the switching circuit being provided to a control assembly that is at least partially disposed within the interior space defined by the housing.

9. The candle of claim 8, wherein the light is supported by the control assembly within the interior space.

10. The candle of claim 9 further comprising a light post that is coupled at a proximate end to the control assembly, extends upwardly from the control assembly, and supports the light adjacent to a distal end of the light post to emit light onto the upper region of the flame member through an aperture formed in the depression floor.

11. The candle of claim 10, wherein the control assembly further comprises a brace that extends upwardly from the control assembly, and a linkage extends between a distal end of the brace and the distal end of the light post.

12. The candle of claim 11, wherein the linkage extends partially about a region vertically above the coil, but does not completely encompass the region vertically above the coil.

13. The candle of claim 1, wherein the light is suspended from the ceiling of the housing, and is electrically connected to a control assembly disposed within the interior space.

14. A candle with a simulated flame, the candle comprising:

a housing that defines an interior space;

a flame member comprising a base, a flame region having a shape resembling a flame silhouette that extends upward from the base, and a lower region that is suspended from the base and supports a swing component formed from a magnetic or ferromagnetic material;

a flame support that pivotally supports the base of the flame member externally of the interior space;

a control assembly at least partially disposed within the interior space defined by the housing, the control assembly comprising a driver including a coil electrically connected to a switching circuit for generating an electromagnetic field that interacts with the swing component in the interior space to cause pivotal movement of the flame member;

a light post that extends upwardly from the control assembly in the interior space;

a light supported adjacent to a distal end of the light post within the interior space to emit light onto the upper region of the flame member through an aperture formed in the housing, and a brace that extends upward from the control assembly, and a linkage extending between a distal end of the brace and the distal end of the light post.

15. The candle of claim 14, wherein the linkage extends partially about a perimeter of a region where the coil is located, at an elevation vertically above the coil, but does not extend completely about the circumference of the perimeter.

16. The candle of claim 15, wherein the brace extends upward from a portion of the control assembly located radially outside of the perimeter of the coil.

17. The candle of claim 14 further comprising a second brace that extends upward from the control assembly, and a second linkage extending between a distal end of the second brace and the distal end of the light post.

18. The candle of claim 17, wherein the second linkage extends partially about a perimeter of the coil, at an elevation vertically above the coil, but does not extend completely about the circumference of the perimeter.

19. The candle of claim 18, wherein the brace extends upward from a portion of the control assembly located radially outside of the perimeter of the coil.

* * * * *